US006987456B2

(12) United States Patent
Kiel et al.

(10) Patent No.: US 6,987,456 B2
(45) **Date of Patent: *Jan. 17, 2006**

(54) PORTAL ANNOUNCING METHOD AND SYSTEM

(75) Inventors: Gerald H. Kiel, Dobbs Ferry, NY (US); Roberta Kiel, Dobbs Ferry, NY (US)

(73) Assignee: Kiel Safety Portals, Inc., Dobbs Ferry, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/088,071

(22) Filed: Mar. 23, 2005

(65) Prior Publication Data

US 2005/0168342 A1 Aug. 4, 2005

Related U.S. Application Data

(63) Continuation-in-part of application No. 10/172,554, filed on Jun. 13, 2002.

(51) Int. Cl.
*G08B 23/00* (2006.01)

(52) U.S. Cl. ..... 340/573.3; 340/5.2; 340/825.36; 340/825.49

(58) Field of Classification Search ..... 340/573.1, 340/5.2–5.5, 5.6–5.64, 825.36, 573.3, 539.11
See application file for complete search history.

(56) References Cited

U.S. PATENT DOCUMENTS 4,660,022 A 4/1987 Osaka
4,686,504 A * 8/1987 German ..... 340/328
5,311,185 A 5/1994 Hochstein et al.
5,475,369 A * 12/1995 Baker ..... 340/573.3
5,541,585 A * 7/1996 Duhame et al. ..... 340/5.62
5,872,516 A * 2/1999 Bonge, Jr. ..... 340/573.3
6,040,774 A 3/2000 Schepps
6,057,756 A 5/2000 Engellenner
6,154,139 A 11/2000 Heller
6,211,781 B1 4/2001 McDonald
6,259,367 B1 7/2001 Klein
6,283,065 B1 * 9/2001 Shorrock et al. ..... 119/863
6,297,737 B1 10/2001 Irvin
2003/0231114 A1 * 12/2003 Kiel et al. ..... 340/573.4

* cited by examiner

*Primary Examiner*—Benjamin C. Lee
*Assistant Examiner*—Son Tang
(74) *Attorney, Agent, or Firm*—Reed Smith LLP

(57) ABSTRACT

A method and system are disclosed for providing an automatic announcement to a person seeking a particular portal in a facility that any particular portal is the one sought. The method comprises the steps of providing the person with a wireless, electronic transmitting and/or receiving device bearing a particular code, providing the portal with a corresponding wireless, electronic transmitting and/or receiving device bearing the particular code, identifying when the code of the device of the person which has been received by the portal device is the same as the code of the portal device and announcing when the personal code and the portal code have been identified as being the same to the person that this portal is the one sought. This invention also has application to veterinary uses.

5 Claims, 2 Drawing Sheets

PORTAL ANNOUNCING METHOD AND SYSTEM

CROSS-REFERENCE TO RELATED APPLICATIONS

This is a continuation-in-part application of U.S. application Ser. No. 10/172,554 filed Jun. 13, 2002.

BACKGROUND OF THE INVENTION a) Field of the Invention

The invention relates to a method and apparatus for automatically announcing an exit or entrance to an individual who seeks that exit or entrance and, more particularly, a method and apparatus for automatically announcing (aurally or visually) an entrance of a particular room to a patient in a hospital or nursing home.

b) Discussion of Need for the Invention

In nursing homes, hospitals and the like, patients often have difficulty finding their own rooms. Their rooms may or may not have room numbers or other identification for this. If they do have visual identification, the patients may not remember it or recognize it. There is no known system which provides an automated announcement or indication to the patient that a particular room is their room.

OBJECTS AND SUMMARY OF THE INVENTION

The primary object of the invention is to provide a method and system which automatically identifies a particular room in a nursing home, hospital facility or the like to a patient seeking that room.

A further object of the invention is to provide a method and system which automatically identifies a particular exit or entrance in a facility to a person seeking that exit or entrance.

In accordance with the invention, a method for providing an automatic indication to a person seeking a particular portal in a facility that any particular portal is the one sought comprises the steps of providing the person with a wireless, electronic transmitting and/or receiving device bearing a particular code, providing the portal with a corresponding wireless transmitting and/or receiving device bearing that particular code, identifying when the code of the device of the person has been received by the portal device and is the same as the code of the portal device and announcing when the personal code and portal code has been identified as being the same to the person that this portal is the one sought. The announcing may be aural and/or visual.

Also in accordance with the invention, a system for providing an automatic announcement to a person seeking a particular portal in a facility that any particular portal is the one sought comprises a wireless, electronic transmitting and/or receiving device to be worn by the person having a unique particular code for identifying that person, a wireless, electronic transmitting and/or receiving device attached to the portal having the same unique particular code, means at the portal responsive to the portal receiving device for identifying when the code of the device of the person has been received by the person has been received by the portal device and means at the portal and responsive to the identifying means for announcing to the person that this portal is the one sought. In one form of the invention, the means for announcing may be aural and/or visual.

DESCRIPTION OF THE PREFERRED EMBODIMENTS

Figure 1:
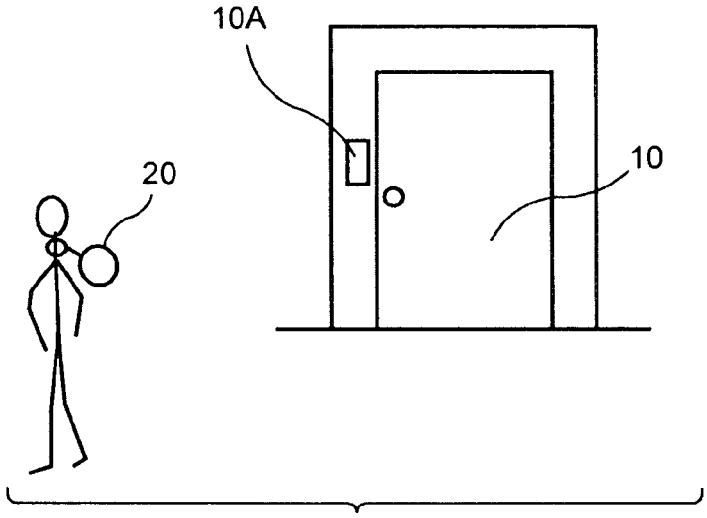
FIG. 1 is a representational drawing of an individual seeking a particular portal for entry.

Referring to FIG. 1, an individual is shown with a carried or worn device 20 in accordance with the invention. Such device may be worn around the neck, on the wrist or somehow attached or pinned to the clothing. The entry point or portal 10 which is sought by such individual has a portal device 10A attached to it. As will be described below, the portal device 10A interacts with the carried or worn device 20 to reveal the identity of the portal to the individual.

As discussed herein, the carried or worn device may be in the form of a pin or broach, a necklace or amulet, a bracelet or the like.

There are two primary preferred forms of interaction between the worn device 20 and the portal device 10A. These two forms are controlled by infrared or RF (radio frequency) interaction. Infrared interaction is necessarily a line-of-sight technique while RF interaction is not limited to line-of-sight interaction.

Two embodiments of the invention will now be described. In the first embodiment shown in FIG. 2, the worn device 20 acts as a beacon to send a coded, pulsed signal which is received by the portal device 10A.

The worn device 20 contains as its primary elements a microprocessor 21 with an embedded (stored) code, a modulator/driver element 22 and a transmitting antenna 23. The coded signal from microprocessor 21 is modulated with appropriate carrier signal (RF or infrared) by the modulator/driver 22 and is then transmitted by the antenna 23.

The portal device 10A includes a receiving antenna 11, a demodulator 12, a microprocessor 13 with embedded or stored code, a comparator 14 which provides an identifying signal 15 and an indicator 16 responsive to the identifying signal 15.

In operation, the portal device 10A receives the transmitted signal from the worn device 20 through antenna 11, demodulates it by demodulator 12 to strip out the coded signal; this coded signal is compared by comparator 14 with the coded signal stored in microprocessor 13. The output of the comparator is identifying signal 15. When the compared codes are the same, the comparator will provide a signal level which identifies identicality. If they are not the same, a signal level will be provided which identifies lack of identicality.

When the level of identifying signal 15 indicates identicality, it will trigger a response by indicator 16 that this portal 10 is the one sought by the individual. Such indicator response may be a sound or series of sounds, a light or a combination of both. In terms of a sound, a prerecorded voice may be released stating something intelligible such as "this is your room, Fannie." A combination of visual and aural indicator responses may be used.

Figure 3:
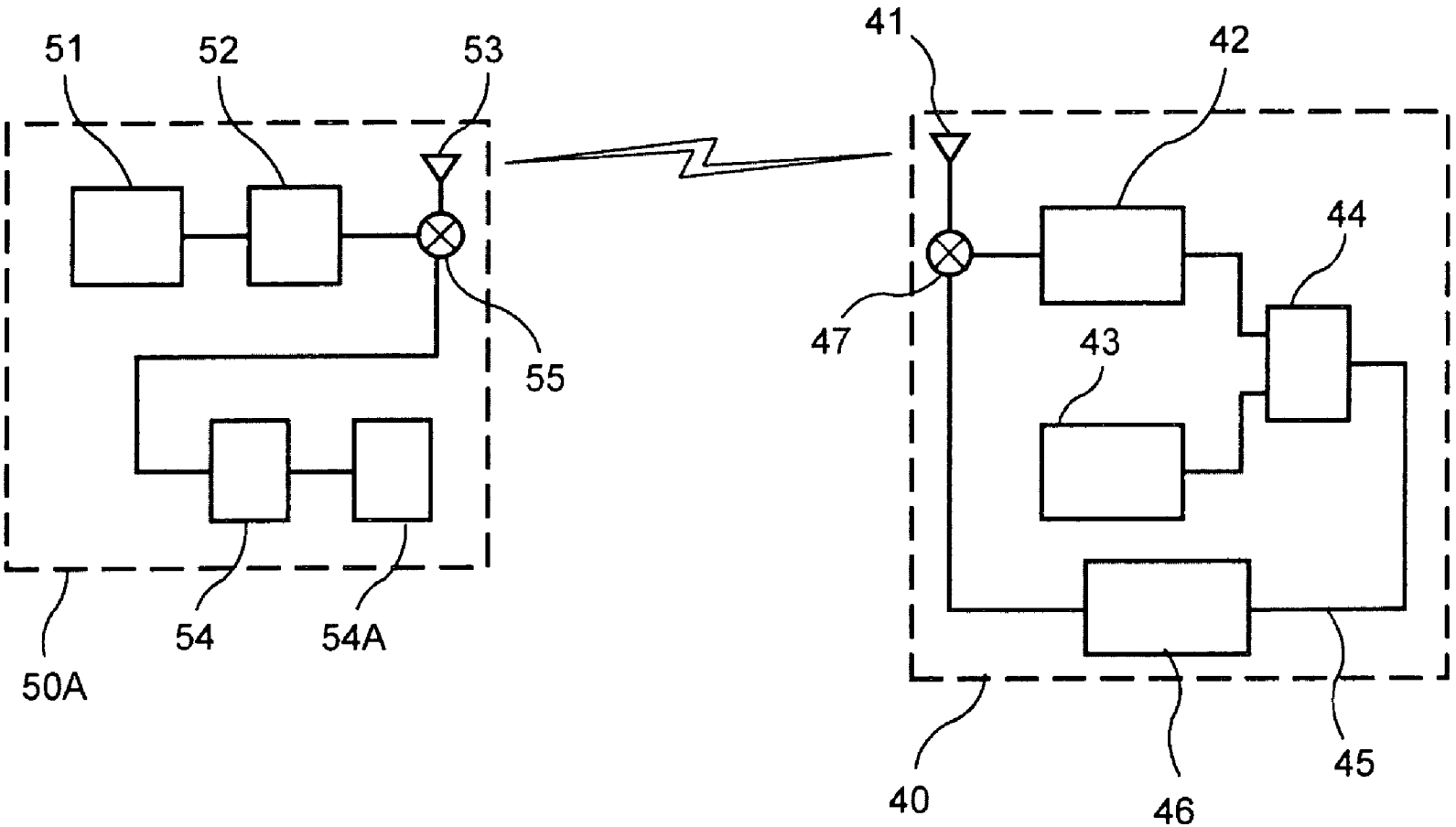
FIG. 3 is an embodiment of the invention where both a carried or worn device and a portal device uses transceivers for exchanging signal information.

In FIG. 3, both the worn device and the portal device are in the form of transceiver elements. In FIG. 3, the worn device is identified as 40 and the portal device by 50A.

The portal device 50A includes a microprocessor 51 with an embedded or stored code, a modulator/driver 52, a transceiver switch 55, a transmitting/receiving antenna 53, demodulator 54 and an indicator 54A.

The worn device 40 includes a transmitting/receiving antenna 41, a demodulator 42, microprocessor 43 a comparator 44, an identifying signal 45, a modulator/driver 46 and a transceiver switch 47.

In this embodiment, the portal device 50A operates so that microprocessor 51 provides a coded signal which is modulated by modulator driver 52 which is directed through transceiver switch 55 to be transmitted over antenna 53.

The signal transmitted through antenna 53 is received by antenna 41 and is directed through transceiver switch 47 to demodulator 42. There, the coded signal is stripped out and compared with the stored signal in microprocessor 43 by comparator 44. The output of comparator 44 is identifying signal 45. When the compared codes are identical, identifying signal 45 will be at a level so indicating; when they are not identical, identifying signal 45 will be at a different level so indicating. When the identifying signal 45 indicates identicality, it is modulated in modulator/driver 46, is directed through transceiver switch 47 and is transmitted through antenna 41. This transmitted signal is received by antenna 53, is passed through transceiver switch 55 which is then directed to demodulator 54. Demodulator 54 provides a signal to indicator 54A. The indicator will provide an aural and/or visual indication as was described with respect to FIG. 2.

Various specific techniques for transmitting and receiving tracking signals are described in U.S. Pat. Nos. 6,211,781, 6,297,737 and 6,154,139, which teachings are incorporated herein by reference. None of these patents are directed to finding a specific portal by an individual such as would take place in a hospital, nursing home, blind person's home or smoke-filled environment.

The inventive method and system are particularly applicable to patients at hospitals or nursing homes who seek their own room.

The invention also has application to veterinary uses. For example, an animal (e.g. a dog) may wear the first wireless, electronic transmitting and/or receiving device having a unique preset code for identification purposes. The second wireless, electronic transmitting and/or receiving device is attached to a portal having the same unique code. The first and second devices directly communicate with each other. Means are provided at the portal responsive to the unique code of the second device for automatically identifying when the unique code of the first device has been received by the second device. Means are also provided at the portal responsive to the identifying means for automatically announcing that this portal is the one sought.

Figure 2:
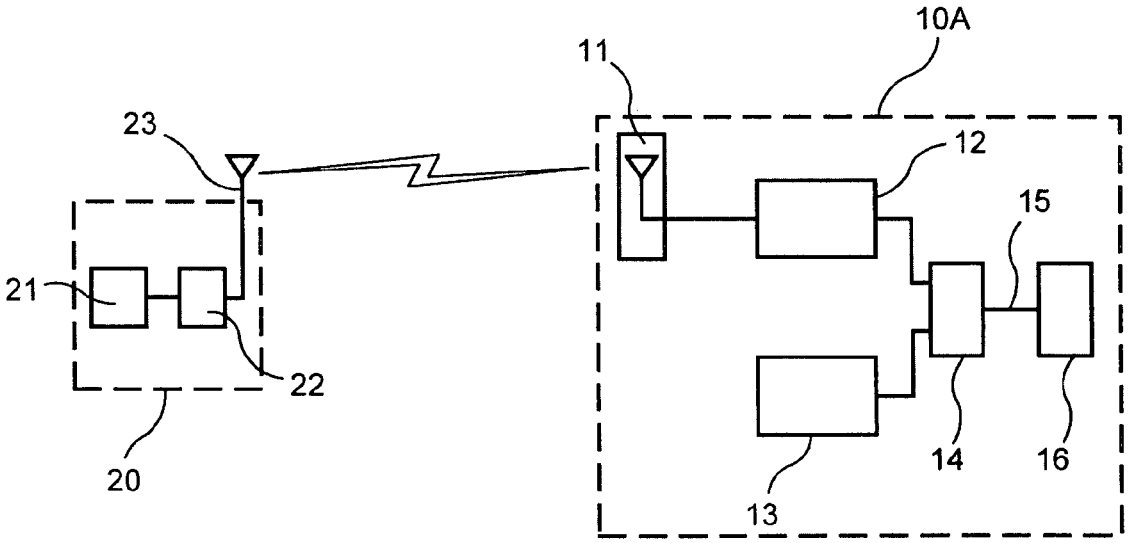
FIG. 2 is an embodiment of the invention where a carried or worn device acts as a beacon and a portal device acts as a receiver/annunciator.

The same elements described in FIGS. 2 and 3 above for persons may be used in this application for animals. The related description is incorporated herein by reference.

In the case of an animal, the automatic announcement may be in the form of a sound command or a visual command. In addition, the automatic identifying means may provide an electronic signal to a known electronic or electromechanical or electromagnetic device for unlatching or opening a door or the like so that the animal may pass through the portal.

While the foregoing description represents the present invention, it will be obvious to those skilled in the art that various changes may be made therein without departing from the true spirit and scope of the present invention.

What is claimed is:

1. A system for providing an automatic announcement to an animal that any particular portal is the one sought comprising:

a first wireless, electronic transmitting and/or receiving device to be worn by the animal and having a unique preset code for identifying that animal;

a second wireless, electronic transmitting and/or receiving device attached to said portal and having the same unique code;

said first and second devices directly communicating with each other;

means at the portal responsive only to the unique code at the second device for automatically identifying when the unique code of the first device of the animal has been received by said second device; and means at the portal responsive to the identifying means for automatically announcing to the animal that this portal is the one sought in a way identifiable by the particular animal.

2. The system of claim 1, wherein the announcing means provides an aural command to the animal.

3. The system of claim 1, wherein the announcing means provides a visual command to the animal.

4. The system of claim 1, also including a device responsive to said identifying means for unlatching a door at the portal so that the animal may pass through the portal.

5. The system of claim 1, wherein said device is of the electronic and/or electromechanical and/or electromagnetic type.

* * * * *